US006558017B1

(12) United States Patent
Saraiji et al.

(10) Patent No.: US 6,558,017 B1
(45) Date of Patent: May 6, 2003

(54) LIGHTING SYSTEM EMPLOYING BI-DIRECTIONAL OPTICS FOR ILLUMINATING PRODUCT DISPLAY UNIT

(75) Inventors: Riad M. Saraiji, Falls Church, VA (US); George L. Rusnak, Clinton, MD (US); Stephen J. Treado, Poolesville, MD (US)

(73) Assignee: Illumitech, Inc., Vienna, VA (US)

( * ) Notice: Subject to any disclaimer, the term of this patent is extended or adjusted under 35 U.S.C. 154(b) by 6 days.

(21) Appl. No.: 10/020,212

(22) Filed: Dec. 18, 2001

(51) Int. Cl.[7] ..... A47F 11/10; A47F 3/04; F25D 11/00

(52) U.S. Cl. ..... 362/125; 362/133; 362/328; 362/337; 312/116; 108/23

(58) Field of Search ..... 362/125, 133, 362/296, 311, 335–337, 328, 92, 225; 108/23; 312/237, 116

(56) References Cited

U.S. PATENT DOCUMENTS

| | | | | |
|---|---|---|---|---|
| 2,822,672 | A | | 2/1958 | Dickson et al. |
| 3,304,740 | A | | 2/1967 | Dickson et al. |
| 3,612,848 | A | | 10/1971 | Koch et al. |
| 3,986,018 | A | | 10/1976 | Ishii |
| 4,000,407 | A | | 12/1976 | Keller et al. |
| 4,005,135 | A | | 1/1977 | Helding |
| 4,145,893 | A | | 3/1979 | Vogel |
| 4,356,540 | A | | 10/1982 | Goralnik |
| 4,361,012 | A | | 11/1982 | Ibrahim |
| 4,489,995 | A | | 12/1984 | Barr |
| 4,544,992 | A | | 10/1985 | Cover |
| 4,704,660 | A | | 11/1987 | Robbins |
| 4,748,545 | A | | 5/1988 | Schmitt |
| 4,825,341 | A | | 4/1989 | Awai |
| 4,887,154 | A | | 12/1989 | Wawro et al. |
| 4,941,327 | A | | 7/1990 | Miles |
| 4,993,561 | A | | 2/1991 | Stultz |
| 5,147,130 | A | | 9/1992 | Watanuki |
| 5,172,973 | A | | 12/1992 | Spada |
| 5,269,231 | A | | 12/1993 | Johnson |
| 5,283,721 | A | | 2/1994 | Powell |
| 5,321,595 | A | | 6/1994 | Jacobi et al. |
| 5,341,275 | A | | 8/1994 | Ghandehari |
| 5,381,320 | A | | 1/1995 | Jordan |
| 5,508,898 | A | | 4/1996 | McGovern |
| 5,517,826 | A | | 5/1996 | Duffy |
| 5,626,028 | A | | 5/1997 | Graat et al. |
| 5,658,067 | A | | 8/1997 | Engle et al. |
| 5,690,415 | A | | 11/1997 | Krehl |
| 5,758,585 | A | | 6/1998 | Latchinian |
| 5,873,646 | A | * | 2/1999 | Fjaestad et al. ..... 362/125 |
| 5,902,034 | A | | 5/1999 | Santosuosso et al. |

* cited by examiner

*Primary Examiner*—Sandra O'Shea
*Assistant Examiner*—Ali Alavi
(74) *Attorney, Agent, or Firm*—Diederiks & Whitelaw, PLC

(57) ABSTRACT

A modular lighting system for illuminating products supported upon various vertically arranged shelves of a display unit includes a housing attached to a first shelf, with the housing including at least one transparent panel which permits an internal illumination source to light products supported upon at least one of the first shelf, a shelf arranged directly above the first shelf and a shelf disposed directly below the first shelf. Most preferably, the light illuminating from the housing is directed so as to effectively, entirely illuminate product support surfaces associated with both the first shelf and the shelf directly below such that the display of products supported anywhere from the front to the back of these shelves is enhanced. This front-to-back lighting function can be achieved in various ways, such as by employing direct, reflective and refractive lighting techniques.

23 Claims, 3 Drawing Sheets

LIGHTING SYSTEM EMPLOYING BI-DIRECTIONAL OPTICS FOR ILLUMINATING PRODUCT DISPLAY UNIT

BACKGROUND OF THE INVENTION

1. Field of the Invention

The present invention pertains to the art of illumination and, more particularly, to a lighting system employing bidirectional optics for use in connection with illuminating one or more shelves of a product display unit.

2. Discussion of the Prior Art

Utilizing lighting units to illuminate products displayed on shelves of display cabinets or the like is widely known in the art. For instance, it is common to attach one or more lighting fixtures within a refrigerated display cabinet of a supermarket in order to illuminate food products supported on vertically spaced shelves of the cabinet. Most commonly, fluorescent lighting is used for this purpose, although it has been known to utilize incandescent lighting.

Regardless of the specific type of lighting source utilized, the additional source of lighting can advantageously enhance the visibility of food products for consumers. Typically, the lighting units are mounted to an upper cabinet panel or directly beneath shelves of the display unit to illuminate food items placed on a lower shelf. Even in the case of display units used to support other products which do not require a dedicated refrigeration system, illuminating the products are still considered desirable.

When contemplating the retrofitting of display units which were not originally designed for use with lighting systems, consideration must be given to numerous factors, including reasonable cost constraints, sizing parameters, the manner in which heat from the lighting system will affect products stored on shelves of the display and the aesthetics of the final is overall unit. In general, little emphasis has been placed in the past on retrofitting food display cabinets or the like with lighting systems. That is, new lighting systems may be designed when production is changed on a refrigerated food display cabinet, but little or no efforts have been undertaken to retrofit existing food display cabinets with more efficient lighting systems or to even add lighting systems to non-refrigerated food product displays.

To address these and other concerns, the present applicant developed a modular lighting system for a product display unit which can be easily retrofitted to standard food display units and that can be readily implemented in the manufacturing of new display units, while having an aesthetic design so as to be pleasing to consumers. This prior proposed modular lighting arrangement is now covered by U.S. Pat. No. 6,179,434. One main purpose achieved by this prior arrangement is to illuminate products arranged at a frontal section of each of the product display shelves. However, it is often necessary to enhance the lighting of products supported on other portions of a display shelf, including a rearmost shelf portion. For instance, in supermarket display units utilized to carry meat products, various different types of meats or cuts are typically arranged from a front portion of a shelf to a rear portion thereof. In such an arrangement, it would be desirable to provide a substantially uniform lighting arrangement between the various meat sections. This problem could be addressed by providing various lighting units dedicated for lighting different portions of each shelf. Obviously, such an arrangement is not very cost effective or efficient, particularly in the environment of refrigerated display units wherein the lighting units actually produce heat which is detrimental to the cooling operation.

Based on the above, there exists a need in the art for a lighting system which will enable a minimum number of lighting units to effectively illuminate essentially entire shelving portions of a product display unit. More particularly, there exists a need in the art to provide such an improved lighting system while still enabling the lighting units to be supported at frontal shelf portions.

SUMMARY OF THE INVENTION

In accordance with the present invention, a modular lighting system is provided for illuminating products supported upon various vertically arranged shelves of a display unit. In accordance with an aspect of the invention, the lighting system includes a housing which is attached to a front end portion of a first shelf, with the housing including at least one transparent panel which permits an internal illumination source to light products supported upon at least one of the first shelf, a shelf arranged directly above the first shelf and a shelf disposed directly below the first shelf. Most preferably, the light illuminating from the housing supported by the first shelf is directed in such a manner so as to effectively, entirely illuminate product support surfaces associated with both the first shelf and the shelf directly below such that the display of products supported from the front to the back of these shelves is enhanced.

In accordance with the invention, this front-to-back lighting function can be achieved in various ways, such as by employing direct, reflective and refractive lighting techniques. The lighting system of the present invention can be readily retrofitted to existing display units or incorporated into newly manufactured display units. In addition, the lighting system is designed to be efficient in operation and structured to enhance the emission of light therefrom.

Additional objects, features and advantages of the present invention will become more readily apparent from the following detailed description of preferred embodiments thereof when taken in conjunction with the drawings wherein like reference numerals refer to corresponding parts in the several views.

DETAILED DESCRIPTION OF THE PREFERRED EMBODIMENTS

Figure 1:
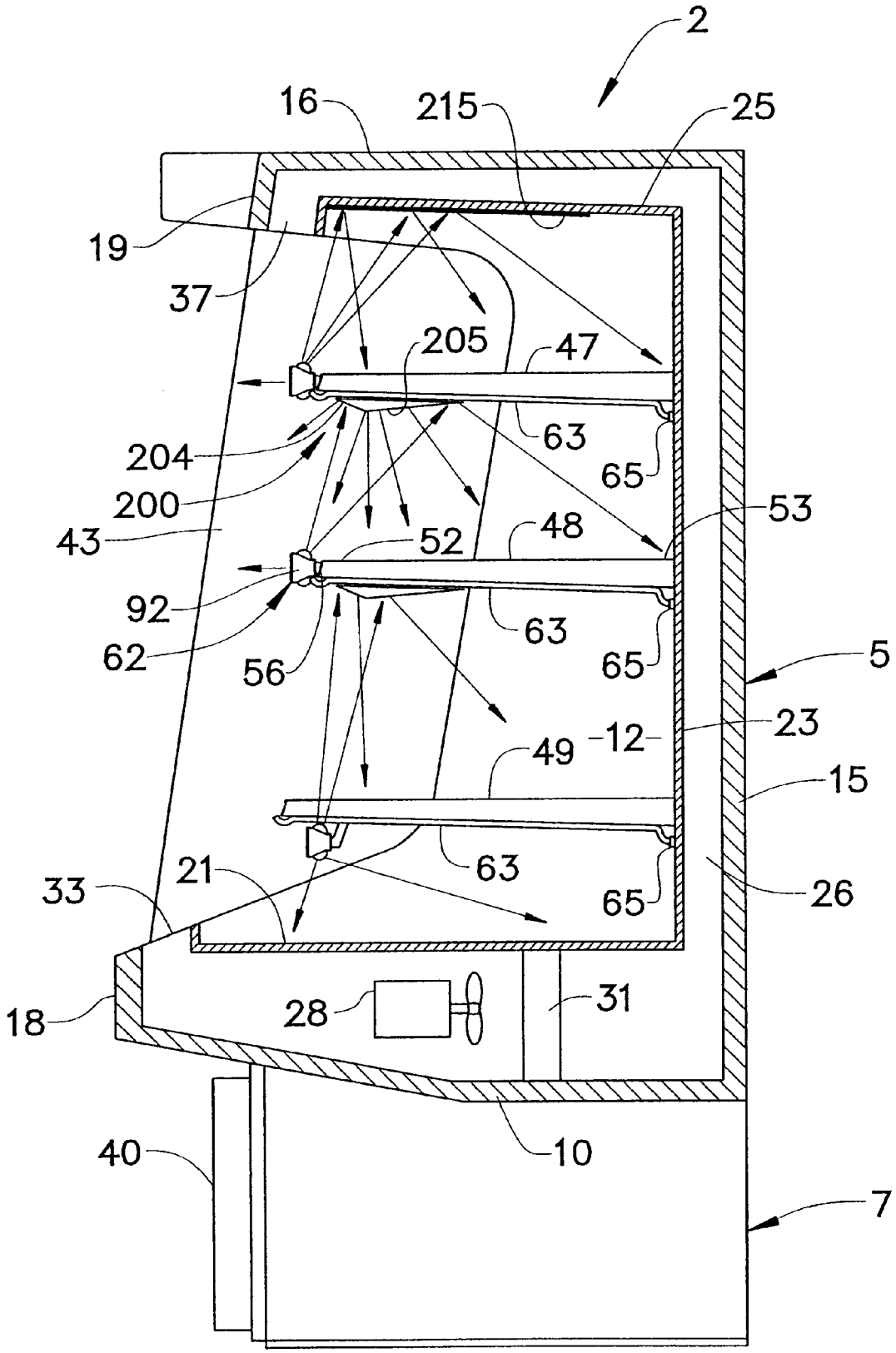
FIG. 1 is a cross-sectional side view of a product display cabinet incorporating the lighting system constructed in accordance with the present invention.

With initial reference to FIG. 1, a refrigerator display cabinet 2 includes an upper frame 5 which is seated upon a base 7. More particularly, upper frame 5 includes a bottom wall 10, opposing side walls 12, a rear wall 15 and a top wall 16. Bottom wall 10 has a front end which is turned upward to define a face portion 18. Similarly, top wall 16 has a front portion which is turned downward so as to define a face portion 19. Upper frame 5 of display cabinet 2 also includes an inner, lower panel 21, a rear panel 23 and a top panel 25. Panels 21, 23 and 25 are spaced from bottom wall 10, rear wall 15 and top wall 16 respectively such that an air flow channel 26 is formed between these portions of display cabinet 2.

Air flow channel 26 forms part of a refrigeration circuit for display cabinet 2. More specifically, a fan 28 is positioned between lower panel 21 and bottom wall 10 to direct a flow of air across cooling coils 31. Fan 28 draws the air through air intake 33 which extends across a lower front portion of display cabinet 2 and which is provided with a grill (not shown). After the air is cooled by passing across cooling coils 31, the air continues to flow through channel 26 to air outlet 37. Although not shown due to the cross-sectional view taken, rear panel 23 would also be provided with a plurality of spaced holes which would further enable a flow of cooling air into display cabinet 2. In general, this cooling of display cabinet 2 is conventional in the art. For this reason, the compressor, evaporator and additional refrigeration system structure is not shown. For a self-contained refrigerated display cabinet 2, these components are mounted within base 7, with the heat generated thereby being able to escape through louvers 40 provided on a front portion of base 7 and the back of display cabinet 2.

In the embodiment shown, display cabinet 2 is also provided with opposing transparent side wall plates 43 which enhance the ability of consumers to view products stored upon a plurality of vertically spaced shelves 47–49 arranged in display cabinet 2. As is known in the art, shelves 47–49 are preferably supported, in a cantilevered manner, from rear panel 23. Shelves 47–49 are used in combination with lower panel 21 to support food products, such as meats which need to be refrigerated, within a supermarket or the like. Except for perhaps a difference in depth, shelves 47–49 are generally identical in construction, with each including a front portion 52 and a rear portion 53 which extend laterally substantially the entire distance between side walls 12, as well as transparent side wall plates 43. Typically, such shelves 47–49 are made of metal but could also be made of plastic as far as the present invention is concerned. In addition, as illustrated with respect to shelf 48, each of shelves 47–49 includes a front face portion 56 that defines a channel 57 (see FIG. 2) designed to receive a pricing label or the like.

As indicated above, the present invention represents an advancement in the lighting system previously disclosed by the present applicant and covered by U.S. Pat. No. 6,179,434 which is incorporated herein by reference. In general, the structure described to this point has been presented for the sake of completeness as the same is known from the '434 patent. As like reference numerals have been utilized in the disclosure of the '434 patent and the present application for certain structural elements, a detailed discussion of these common elements will not be provided here. In a manner similar to the prior proposed system, the lighting system of the present invention includes one or more lighting units, one of which is indicated at 62 in each of FIGS. 1 and 2, for illuminating products displayed within cabinet 2. In the embodiment shown in FIGS. 1 and 2, a separate lighting unit 62 is mounted across the face portion 56 of each of shelves 47 and 48, while an additional lighting unit 62 is attached beneath a frontal portion of shelf 49. In a manner directly corresponding to the disclosure in the '434 patent, each lighting unit 62 includes a power cord 63 including a terminal plug 65 which is received within a socket (not shown) formed in rear panel 23, end caps 92 and a plurality of spaced support brackets 102. With this arrangement, each lighting unit 62 can be mounted beneath a particular shelf, as in the case of shelf 49, or attached to face portion 56, as in the case of shelves 47 and 48.

Figure 2:
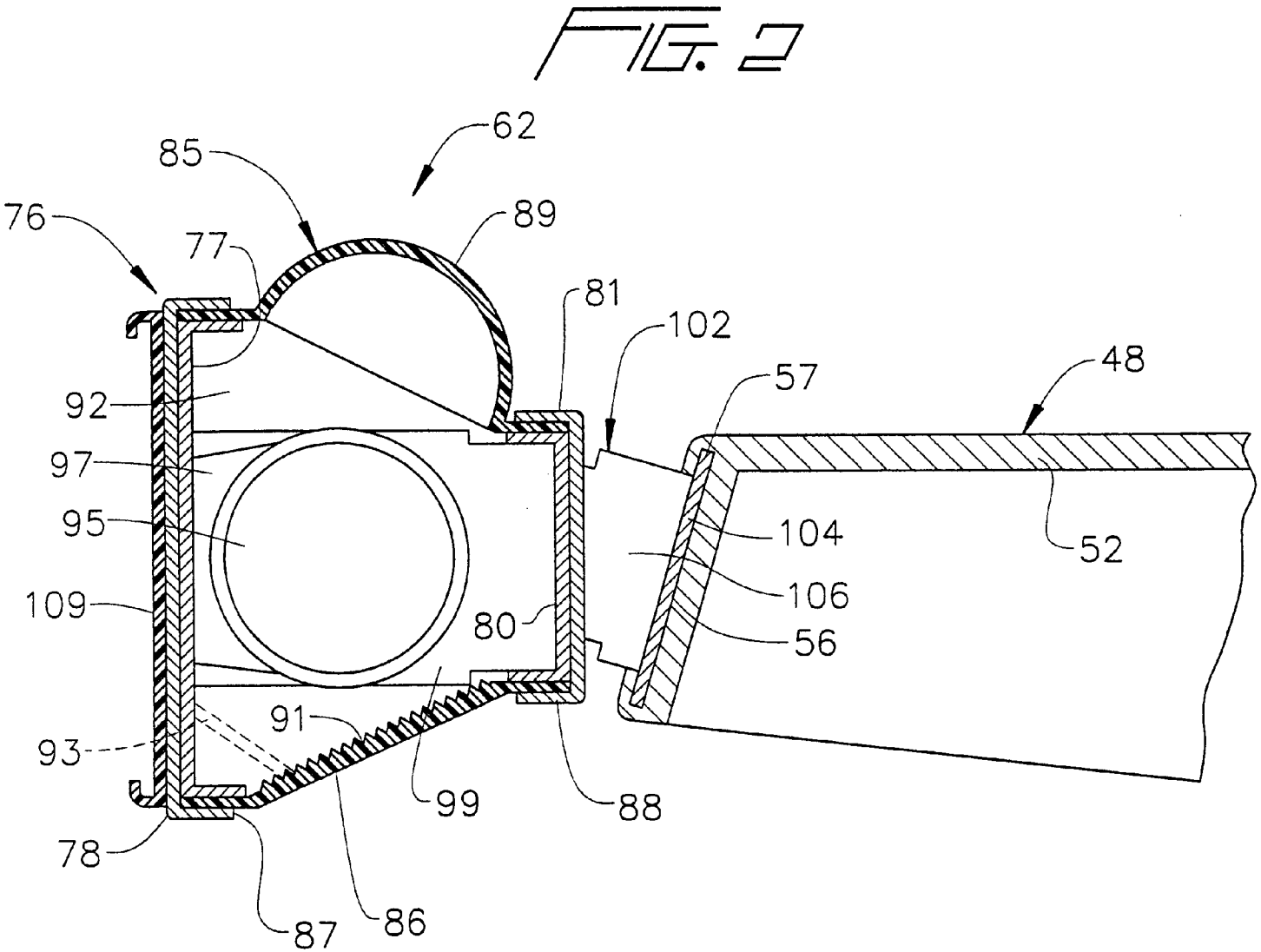
FIG. 2 is an enlarged, cross-sectional side view showing details of a lighting unit, as well as the mounting thereof to a shelf of the cabinet, in accordance with a preferred embodiment of the invention.

FIG. 2 illustrates a preferred construction for each lighting unit 62 in accordance with the present invention. As shown in this figure, lighting unit 62 includes a housing 76 preferably formed from inner and outer front, generally U-shaped plates 77 and 78, inner and outer rear, generally U-shaped plates 80 and 81, and upper and lower transparent plates 85 and 86. Inner and outer front U-shaped plates 77 and 78 are interconnected together. In a similar manner, inner and outer rear U-shaped plates 80 and 81 are interconnected together. As clearly shown in FIG. 3 with respect to lower transparent plate 86, a front end portion 87 of lower transparent plate 86 is received between non-labeled leg portions of inner and outer U-shaped plates 77 and 78 respectively, while a rear end portion 88 of lower transparent plate 86 is received between unlabeled legs of inner and outer rear U-shaped plates 80 and 81. A similar mounting arrangement is utilized in connection with upper transparent plate 85.

At this point, it should be realized that U-shaped plates 77, 78, 80 and 81, as well as plates 85 and 86, all preferably extend the entire width of housing 76, with that width being substantially equal to the width of any one of shelves 47–49. As also shown in FIG. 2, plate 85 includes an elongated convex or dome-shaped lens section 89, while between front end portion 87 and rear end portion 88 of lower transparent plate 86 is defined an undulating, diffuser plate section 91. To complete housing 76, end caps, as best shown in FIGS. 1 and 2 at 92, extend across and about each of the inner and outer U-shaped plates 77, 78, 80 and 81. It should also be noted that a reflector, indicated in phantom at 93 in this figure, could also be employed to perform the desired light control function.

Mounted within housing 76 is an illumination source 95. Although illumination source 95 can take various forms, including fluorescent and incandescent lamps, a fiber optic/light guide arrangement and the like, a single elongated fluorescent lamp is preferably utilized. In connection with this preferred embodiment, each end portion of housing 76 is provided with an electrical socket, such as that shown in 97. Although not clearly shown in this drawing due to the cross-section taken, each socket 97 is preferably secured to housing 76 through the use of a first mechanical fastener that extends through inner and outer front U-shaped plates 77 and 78, as well as a second mechanical fastener extending through inner and outer rear U-shaped plates 80 and 81. In a most preferred form, these mechanical fasteners take the form of nuts and bolts with lock washers. However, other attachment arrangements, including welding and the like could equally be applied. In any event, the attaching of sockets 97, in combination with end caps 92, aid in maintaining a desired spacial relationship between the sets of inner and outer plates 77, 78 and 80, 81 and enhance the structural integrity of the overall housing 76. Preferably, each of the sockets 97 is actually carried by a respective bracket 99 which itself is affixed between the sets of plates 77, 78 and 80, 81. Of course, suitable electrical wiring interconnects the end sockets 97 and extends out of housing 76 to define power cord 63 in order to provide electrical energy to illumination source 95.

Attached to housing 76 and projecting from outer rear U-shaped plate 81 is a plurality of laterally spaced support brackets 102. Each support bracket 102 includes a base 104 that is spaced from outer rear U-shaped plate 81 and attached to housing 76 by a pair of legs 106 of support bracket 102. In the preferred form, each support bracket 102 is formed by bending a single piece of sheet metal to define the base 104 and legs 106. Legs 106 are actually in-turned to define tab portions which are secured to outer rear U-shaped plate 81. In the most preferred form, mechanical fasteners extend through both of inner and outer rear U-shaped plates 80 and 81 and through the tabs associated with legs 106.

For the sake of completeness, the base 104 of each support bracket 102 in the preferred embodiment is approximately 5 inches (12.7 cm) in length, with one support bracket 102 being arranged adjacent each terminal end of housing 106 and a third support bracket 102 being centrally disposed long the length of housing 62. With this arrangement, the brackets 102 are spaced in the order of 16 inches (approximately 40 cm), while each base 104 is also spaced from the outer rear U-shaped plate 81. Given that the sheet metal used to form support brackets 102 is extremely thin, i.e., in the order of 3/100 of an inch or 0.1 cm, there is very minimal surface area for which to conduct heat generated from illumination source 95 from housing 76 through support brackets 102 to a respective one of shelves 47–49. Instead, numerous air gaps are created between housing 76 and a respective shelf 47–49. Therefore, this bracket arrangement is particularly constructed in this fashion to provide this thermal insulating function.

As shown, a lighting unit 62 is preferably attached to the face portion 56 of a respective shelf 47 and 48 so as to act as an extension of the shelf, while an additional lighting unit 62 is mounted beneath a front portion of shelf 49. In the case of shelves 47 and 48, each shelf 47, 48 is initially removed from within display cabinet 2 such that the base 104 of each support bracket 102 can be successively slid into the label receiving channel 57 of the particular shelf 47, 48. In any event, each lighting unit 62 is suspended from the particular shelf 47–49. In this manner, it is very easy in accordance with the present invention to retrofit a conventional refrigeration display cabinet.

Given that label receiving channel 57 is angled with respect to a vertical, it is preferable in accordance with the present invention to form the support brackets 102 such that each leg 106 extends further from a respective shelf 47, 48 at an upper portion of housing 76 thereof than at a lower portion. This is clearly illustrated in FIG. 2. With this construction, the base 104 of each support bracket 102 is arranged farther from outer rear U-shaped plate 81 at a top end than at a bottom end. For instance, in the most preferred form, each base 104 is spaced approximately 9/16 inch (1.5 cm), while the lower end of each leg creates a space in the order of 0.28 inches (approximately 0.7 cm). This angling of legs 106 assures the optimal arrangement for upper and lower transparent plates 85 and 86 to enhance the lighting of products supported on shelves 47–49 by the illumination source 95 of the lighting unit 62. Since lighting unit 62 can utilize the label receiving channel 57 for mounting purposes, it is desirable to provide each lighting unit 62 with its own label area. This can take various forms in accordance with the present invention. For instance, FIG. 2 indicates a label holder 109 which generally constitutes a magnetic or adhesively attached channel-shaped strip that is mounted to outer front U-shaped plate 78 of housing 76.

As indicated above, it is important in accordance with the present invention that each shelf 47–49 be adequately illuminated from front portion 52 to rear portion 53. The same is also desired for lower panel 21. Given that each lighting unit 62 is attached at a respective front portion 52, provisions must be made to distribute the light entirely over these potential display zones. In accordance with one embodiment of the invention, this light distribution is accomplished by incorporating a reflector, such as that indicated at 200 below shelf 47. With this arrangement, light illuminating from source 95 is directed upward through lens section 89 unto different portions of reflector 200. Preferably, reflector 200 includes a short, planar front angled portion 204 and a longer, planar rear angled portion 205, which define an obtuse angle there between as clearly shown in FIG. 1. Therefore, based on this structure, the light illuminating from source 95 is directed onto different portions of reflector 200 and then substantially, evenly directed or distributed for the entire depth of shelf 52. In addition, due to the presence of front angled portion 204, some of the light is directed in front of the entire display unit 2. Obviously, only a limited number of light ray representative lines can be reasonably shown in this figure. Regardless, it should be recognized that lighting unit 62 mounted to the front portion 52 of shelf 48 functions in accordance with the invention to illuminate products supported anywhere between front portion 52 and rear portion 53.

As described above, lighting unit 62 as represented in FIG. 2 can incorporate a diffuser 91 to perform a similar function to lens section 89. In accordance with the invention, diffuser section 91 is configured to disperse light from source 95 in a manner similar to lens section 89. That is, FIG. 1 indicates how diffuser 91, formed as part of the lighting unit 62 mounted under shelf 49 by a suitable bracket (not labeled), can be used to distribute the light over the entire lower panel 21. Again, only a few representative lines for the light are shown, but it is to be understood that additional rays of light exist between and beyond the two rays shown.

At this point, it should also be noted that an additional lens section 89 could be equally substituted for diffuser 91 such as represented with lighting unit 62 attached to shelf 47. Therefore, plate 86 can be constituted by a dark panel which does not allow light to pass through, a diffuser 91 or a lens 89. Obviously, if plate 84 is constituted by either a diffuser 91 (FIG. 2) or a lens 89, light will project both above and below housing 76. This feature enables a single lighting unit 62 to illuminate below a particular shelf, along with the shelf to which the lighting unit is mounted due to the presence of reflector 200 which also functions to disperse the light. If the shelf above the lighting unit is transparent as represented in connection with shelf 49, the lighting unit 62 can even project through a forwardmost portion of the shelf and be reflected back onto the food product.

Figure 3:
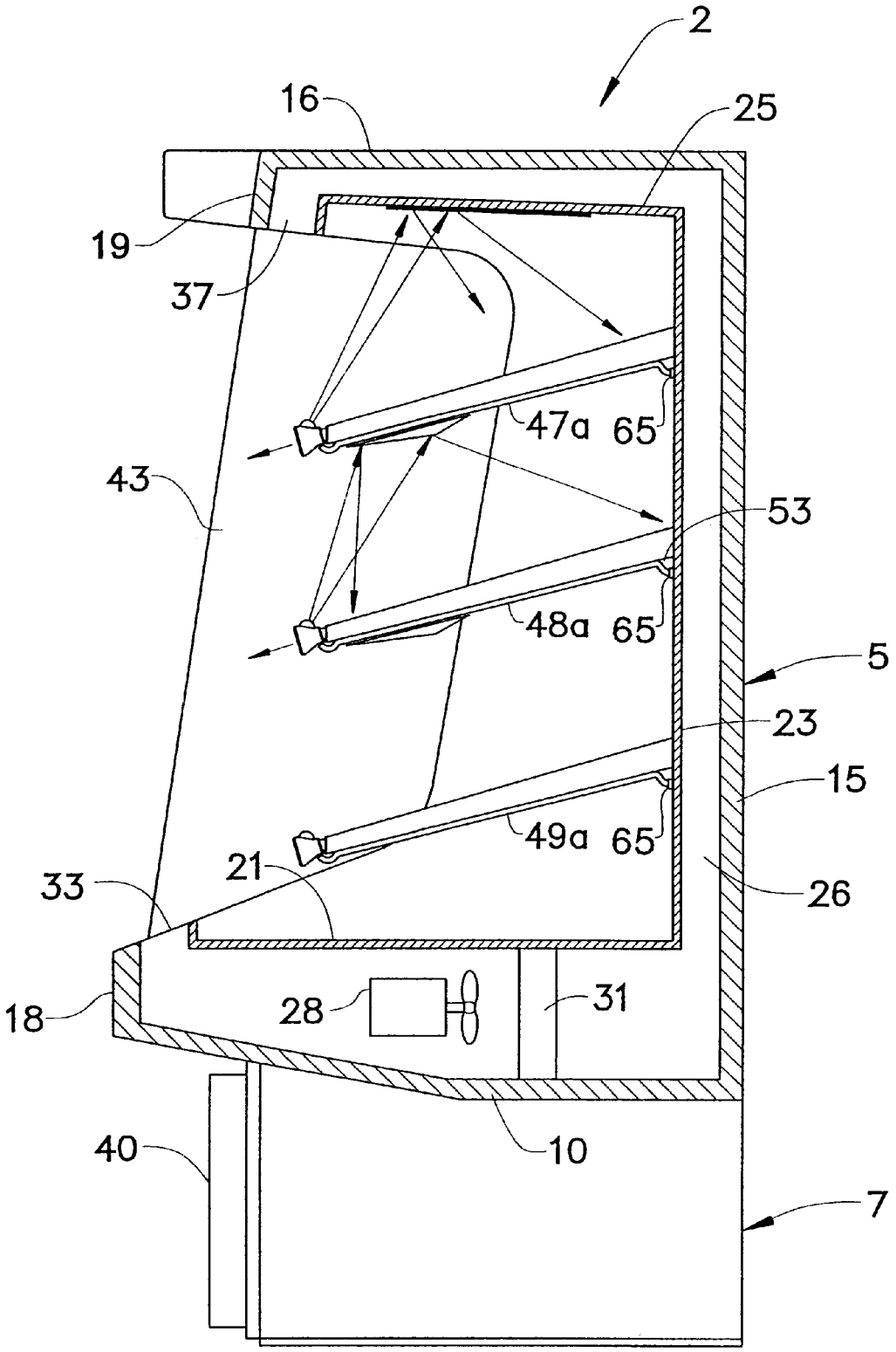
FIG. 3 is a cross-sectional side view of another product display cabinet incorporating the lighting system of the invention.

FIG. 1 also illustrates the possibility of providing a reflective coating above a portion of a shelf, such as coating 215 provided upon upper panel 25 above shelf 47, to direct the rays of light back down onto shelf 47 from the lighting unit 62 mounted to shelf 47. Furthermore, FIG. 3 illustrates an embodiment wherein display cabinet 2 includes angled shelves 47*a*–49*a*. Due to the angling of shelves 47*a*–49*a*, it should be noted that reflectors 200 may be reversed such that longer angled portion 205 is arranged in front of short angled portion 204. Regardless of the particular control arrangement employed, the lighting system of the invention enables light generated at a front end portion of a product display shelf to be initially directed away from the shelf and then re-directed back to a product supporting surface of the shelf. In addition, the light is directed in such a manner so as to effectively illuminate the entire product support surface. Furthermore, the same lighting unit can be used to effectively illuminate another product support surface below the shelf such that the actual number of required lighting units is minimized.

Although described with respect to preferred embodiments of the invention, it should be readily understood that various changes and/or modifications can be made to the invention without departing from the spirit thereof. For instance, the overall configuration of lens section 89, diffuser 91 and/or reflector 200 can be readily varied in accordance with the invention in order to accommodate different sized and shaped shelving configurations. In addition, even though housing 76 has been indicated to be separately made, housing 76 could be integrally formed, either in whole or in part, with portions of display cabinet 2, such as one or more of the various shelves 47–49. Furthermore, the actual construction of support brackets 102 could greatly vary, such as being continuous across housing 76 or integral with base 104. The same is true with respect to label holder 109 which can readily be made integral, such as through plastic or aluminum extrusion, with housing 76. Finally, it should be readily understood that the number of lighting units can actually be reduced from that shown in the drawings, while still enabling the illumination of all of the shelves 47–49, so as to minimize manufacturing and energy costs. In general, the invention enables a lighting unit 62 mounted on a given shelf 47–49, 47*a*–49*a* to illuminate at least a bottom portion of an upper shelf, but can illuminate the upper surface of the shelf to which the lighting unit is attached and/or below the shelf through the use of reflective or refractive illumination techniques. In any event, the invention is only intended to be limited by the scope of the following claims.

We claim:

1. In a product display unit including at least first and second vertically spaced product display shelves each having a product supporting surface with front and rear, laterally extending end portions, a lighting system comprising:

an elongated housing having terminal end portions, said housing being adapted to extend from the first shelf, said housing including upper and lower panel portions, with a section of at least one of the upper and lower panel portions being transparent;

an illumination source mounted within the housing, said illumination source being adapted to generate light directed toward the second shelf; and at least one light control element redirecting the light to illuminate from substantially the front portion to the rear portion of the product supporting surface of the first shelf.

2. The lighting system according to claim 1, wherein the at least one light control element constitutes a refractor provided at the section of the at least one of the upper and lower panel portions.

3. The lighting system according to claim 1, wherein the at least one light control element constitutes a lens provided at the section of the at least one of the upper and lower panel portions.

4. The lighting system according to claim 3, wherein the lens is generally convex.

5. The lighting system according to claim 1, wherein the light control element constitutes a reflector.

6. The lighting system according to claim 5, wherein the reflector is provided on a lower surface portion of the second shelf.

7. The lighting system according to claim 5, wherein the reflector includes first and second portions, with the first portion of the reflector extending at an angle relative to the second portion.

8. The lighting system according to claim 7, wherein the angle is obtuse.

9. The lighting system according to claim 7, wherein each of the first and second portions of the reflector are substantially planar.

10. The lighting system according to claim 5, wherein the reflector constitutes a coating provided on the lower surface portion of the second shelf.

11. The lighting system according to claim 1, wherein the light is directed from the housing both above and below the first shelf.

12. The lighting system according to claim 1, wherein the light is directed from the housing through the first shelf.

13. The lighting system according to claim 1, wherein the at least one light control element is provided at the upper panel portion of the housing on the front end portion of the first shelf.

14. The lighting system according to claim 13, further comprising: a second light control element provided on a lower surface portion of the second shelf, said light being directed from the at least one light control element onto the second light control element and then back to the first shelf.

15. The lighting system according to claim 1, wherein the housing is extendsw from the front end portion of the first shelf.

16. A method of lighting a product display zone of a product display unit comprising:

generating light from within a housing mounted to a first shelf of the product display unit;

directing the light away from the first shelf; and re-directing the light across substantially the entire product display zone defined from a front portion to a rear portion of the first shelf.

17. The method according to claim 16, wherein the light is reflected back onto the product display zone.

18. The method according to claim 17, wherein the light is reflected back onto the first shelf from a reflector provided on a second shelf arranged above the first shelf.

19. The method according to claim 16, wherein the light is directed away from the first shelf through a refractor attached to the housing.

20. The method according to claim 16, wherein the light is directed away from the first shelf through a lens attached to the housing.

21. The method according to claim 16, wherein the light is directed away from the first shelf by a reflector attached to the housing.

22. The method according to claim 16, wherein a first portion of the light is directed above the first shelf and a second portion of the light is directed below the first shelf.

23. The method according to claim 16, wherein the light is directed through the first shelf and then directed away from the shelf.

* * * * *